United States Patent [19]

Berentzen

[11] Patent Number: 4,562,705

[45] Date of Patent: Jan. 7, 1986

[54] COMPOSITE PUNCHED KNITTING ELEMENT, FOR EXAMPLE KNITTING MACHINE KNITTING NEEDLE

[75] Inventor: Hardo Berentzen, Albstadt, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 603,886

[22] Filed: Apr. 24, 1984

[30] Foreign Application Priority Data

Apr. 23, 1983 [DE] Fed. Rep. of Germany ..... 3314809

[51] Int. Cl.[4] ..... D04B 35/04

[52] U.S. Cl. ..... 66/121

[58] Field of Search ..... 66/121, 123

[56] References Cited

U.S. PATENT DOCUMENTS

| | | | |
|---|---|---|---|
| 3,805,362 | 4/1974 | Heaven | 29/417 |
| 4,036,036 | 7/1977 | Ashmead et al. | 66/123 |
| 4,237,705 | 12/1980 | Petrov | 66/123 |
| 4,452,053 | 6/1984 | Egbers et al. | 66/123 |

FOREIGN PATENT DOCUMENTS

| | | | |
|---|---|---|---|
| 1635837 | 1/1970 | Fed. Rep. of Germany . | |
| 2553547 | 6/1976 | Fed. Rep. of Germany . | |
| 2610078 | 9/1977 | Fed. Rep. of Germany . | |
| 2820925 | 11/1979 | Fed. Rep. of Germany . | |
| 2843014 | 4/1980 | Fed. Rep. of Germany . | |
| 3014751 | 10/1981 | Fed. Rep. of Germany . | |
| 2010367 | 6/1983 | Fed. Rep. of Germany | 66/121 |
| 57-9433 | 2/1982 | Japan | 66/123 |

*Primary Examiner*—Ronald Feldbaum

*Attorney, Agent, or Firm*—Frishauf, Holtz, Goodman & Woodward

[57] ABSTRACT

To provide for damping of vibrations or oscillations exerted on the shaft or shank (7) of a knitting element, and thus reduce breakage of the shaft or shank and failure of the head portion thereof, the shaft or shank is formed with solid guide portions (10) of which at least one is in alignment with a butt extending from the shaft or shank. Two solid guide portions are connected by at least one connecting bridge portion (12) of only up to 1.1 mm height, and which defines an opening (11, 11*a*, 11*b*) therebeneath, with respect to the remaining edges of the shaft, which opening is filled with vibration or oscillation-damping material, such as a plastic or a metal, flush, or slightly recessed with the side surfaces of the shaft, and securely bonded to the edges of the adjacent bridge portion and the spaced solid guide portions facing the opening. The guide portions may be of different longitudinal dimension, for example have a dimension of only of that in the order of the bridge portion. The bridge portions can be located in longitudinal alignment, or can be offset to result, in combination with adjacent guide portions, in a meander arrangement made of metal, typically steel, with the openings defined by the meander arrangement being filled with the vibration or oscillation-damping material, and bonded to the adjacent steel parts of the meander arrangement.

27 Claims, 9 Drawing Figures

COMPOSITE PUNCHED KNITTING ELEMENT, FOR EXAMPLE KNITTING MACHINE KNITTING NEEDLE

The present invention relates to knitting machine elements, and more particularly to knitting elements such as knitting needles of the beard or latch type, sinkers, plush loops, jacks, terry or pile-forming elements and the like.

BACKGROUND

Various types of knitting elements are used in knitting machines which may be of the flat-bed or circular machine type. Typical elements are described, for example, in German Pat. No. 28 20 925 to which U.S. Pat. No. 4,452,053, Egbers et al, corresponds and German Patent Disclosure Document DE-OS 30 14 751.

It is a continuous endeavor to increase the operating speed of knitting machines. The head portions of the knitting elements which are engaged by the knitting yarn or threads are increasingly stressed, and the heads, and especially hook portions thereof then tend to break. In order to prevent such breakage, and to increase the lifetime and operating duration of the knitting elements, it has been proposed to couple the foot or butt portion of the respective knitting elements with the head portion by a section which is somewhat resilient. Consequently, the shaft of the knitting element is sometimes made to be resilient or has a somewhat resilient portion to permit the entire element to vibrate or oscillate with damped vibrations and oscillations. The impact energy applied to the foot or butt portion of the knitting element can thus be absorbed and transferred into bending forces in the element itself. One arrangement of this type is described in U.S. Pat. No. 4,452,053, in which an intermediate portion is located between the head end and the foot or butt end of a knitting needle, which intermediate portion has a length of at least 8 mm and a width of at the most 1.1 mm. Increasing the width of the strip or rib formed thereby, and increasing the length of this low-dimensioned strip decreases the tendency of the needle to break at the head or hook portion thereof.

It is not possible, unfortunately, to decrease the width of the strip and increase its length too much since the stability of the knitting element otherwise will be impaired. In order to increase the stability of knitting tools, it has been proposed (see German Pat. No. 30 14 751) to provide two ribs, one of which has a width of at the most 1.1 mm and, further, a lower rib of the same width or a lesser width. A free space or hole will then be defined between the respective ribs which may be subdivided by a connecting piece. The length of this free space, subdivided or not, is at least 8 mm.

Limits are placed on the increase in needle operating speed by reduction of the width of the respective connecting strips. These elements, which are all made by punching, have the characteristics that head or hook breakage is decreased; yet, as the shaft portion is reduced in effective cross section, the danger of breakage of the shaft increases. The decrease in head breakage, thus, will result in an increase in shaft breakage and a suitable compromise or balance must be found.

Investigation of the forces acting on the knitting tools, for example knitting needles, have shown that the forces stress the needle butt by applying blow-like pulse thereagainst which will be transferred into bending forces in the resilient, bendable portions of low width within the needle. These bendable portions will transfer the bending forces into bending oscillations which have amplitude excursions deviating from the plane of symmetry of the respective knitting element. The rapidly occurring impacts acting on the needle butt may become additive in the vibrations or oscillations of the needle so that the material of the needle will be subjected to fatigue which leads to breakage of the needle shaft or shank. The oscillations imposed by the impacts due to the cams acting on the needle may modulate each other, and may be in phase synchronism, or may be phase-shifted. Under some operating conditions, the superimposed oscillations may so occur, in time, with respect to each other that a substantial portion of the impact energy is transferred to the hook portion or head portion of the knitting element, and hence, again, leads to premature destruction thereof.

It has been proposed—see Japanese Utility Model 57/9433—to punch an opening in the shaft of latch knitting needles which, otherwise, is solid and extends from the needle head to the butt or foot end thereof. The opening may extend up to the back side of the shaft, and is filled with material absorbing vibration, such as a plastic or the like. The vibration-absorbing material extends beyond the side surfaces of the needle shaft or needle shank. The entire shaft or shank is massive. The purpose of this arrangement is to constrain transverse movement of the needle within the needle groove and to prevent slithering movement of the needle which may be caused by impacts applied to the needle foot or butt end. The vibration-absorbing material, extending laterally over the sides of the needle shaft, and engaging in the surfaces defining the needle groove, then, will prevent such lateral vibration. A needle with a massive needle shaft, retained snugly in the groove by a plastic insert, cannot be operated and is not comparable to a needle made as a punched element which has its shaft reduced to the small width of about 1.1 mm to form a highly resilient portion therein. The massive shaft with the plastic insert provides little resiliency along a dimension at right angles to the longitudinal extent of the needle, that is, permitting bending excursions in the plane of the needle shaft itself.

THE INVENTION

It is an object to provide a punched knitting machine element, for example a knitting machine needle, jack, hook, sinker, or the like, in which a needle shaft carries a head at one end thereof and a butt or foot portion at the other. The needle shaft has at least two spaced solid guide portions which extend from an upper edge of the needle shaft to the lower edge thereof, one of which is located in alignment with, or may form an extension of, the butt of the shaft. In accordance with a feature of the invention, the two spaced guide portions are connected by at least one bridge portion which has up to 1.1 mm height and defines an opening therebeneath; this opening will thus be bounded by the at least one connecting bridge portion and the facing edges of the spaced solid guide portions. The opening is filled with vibration damping material, which is securely connected to the edges of the adjacent metal portions of the punched element, that is, to the edges of the at least one bridge portion and the spaced solid guide portion facing the opening. The vibration-damping material, thus, enhances the longitudinal strength of the needle to prevent breakage of the thin bridge portion while being capable of absorbing and damping shocks. The secure connection with the bridge portion and the adjacent faces of the solid guide portions, for example by bonding thereto, prevents loss or looseness thereof with respect to the remainder of the metal portions of the punched needle shaft. In accordance with a feature of the invention, the plastic material extends in alignment with the metal portions of the shaft, that is, at least the connecting bridge portion and the adjacent guide portions, or may even be recessed inwardly with respect thereto. In accordance with a feature of the invention, the connecting bridge portions forms at least one of the edges, for example the upper or lower edge of the needle shaft, and two such connecting bridge portions may be provided, located for example in alignment and extending from either side of a guide portion, or located out-of-alignment so that the metal part of the punched knitting element will be in meander shape, each one of the openings beneath the connecting bridge portions facing opposite edges of the shaft, and being filled with the vibration-absorbing material. The guide portions, extending from the upper edge to the lower edge of the needle shaft, need not all have the same width, and may, indeed, be formed by narrow, thin strips of essentially the same dimensions as, or only slightly larger than the connecting bridge portions.

It has been found, surprisingly, that the combination of a resilient filling, which may be plastic, a metal or metal alloy such as aluminum, or the like, with thin connecting ridge strips, gives the needle the requisite elasticity, with appropriate damping and still permits use of shaft portions which are sufficiently thin and resilient, while, additionally, providing for the necessary strength of the shaft, so that the lifetime of the needles will be substantially improved over and beyond those which have only narrow connecting strips or only resilient elements. This was unexpected since a metal, typically a steel connecting strip having a width of at the most 1.1 mm, is a highly flexible bendable element, the oscillation or vibration characteristics of which are, however, influenced by the vibration damping material which is bonded thereto along its entire length.

The vibration-damping material, preferably, is made of an elastic plastic material having high damping characteristics; it may, however, also be some other suitable material such as a metal or a metal alloy. Usually, the vibration damping material will be flush with the adjacent side surfaces of the shaft or shank of the knitting element, so that the shaft or shank will have smooth uninterrupted side surfaces. For some applications, however, it is possible to slightly internally offset the lateral surfaces of the vibration-damping material with respect to the side surfaces of the shaft, so that they are slightly inwardly relieved. This arrangement may be suitable, for example, if the thickness of the damping material is to be selected to be slightly thinner than the surrounding material of the shaft of the knitting element in view of the damping characteristics of the vibration-damping material.

DRAWINGS

DETAILED DESCRIPTION

The invention will be described in connection with knitting machine latch needles although, of course, it is to be understood that it is not limited thereto, since it is directed, essentially, to the construction of the shaft of a knitting machine element; the head portion of the shaft may be arranged in accordance with any suitable or desired shape, as required by the particular function the element is to perform in a knitting machine, and may, for example, be a straight portion, as used in a jack.

The latch needles which are illustrated have a head portion formed as a hook 1, with an adjacent neck or throat 2, which merges into a needle cheek 3. A longitudinal slit is formed, as is customary, in the check in which the latch 4 is pivotably secured. The connection between the latch and the cheek is schematically shown at 5, and may be a rivet, oppositely located inwardly directed punched tips or the like.

Figure 3:
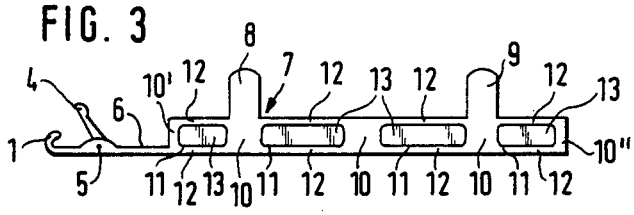
FIG. 3 is a schematic side view of another embodiment of the needle of FIG. 1.

A needle groove portion 6 extends beyond the cheek. The shank or blade 7 extends to the back of the needle which carries a butt 8. Additional butts may be provided, such as one or more patterning butts 9 (FIG. 3).

Figure 1:
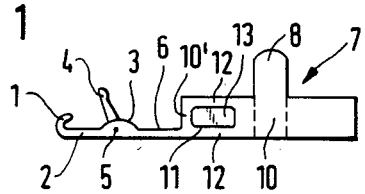
FIG. 1 is a side view of a latch needle in accordance with the invention, in which the upper connecting bridge of the shaft and the lower connecting bridge of the shaft have, at the most, 1.1 mm width.

The portion beneath the butt 8 forms a guide portion 10. Guide portion 10 is a solid portion extending from the upper edge of the shaft to the lower edge thereof. FIG. 1 additionally shows broken lines to outline the guide portion 10 beneath the butt 8; these broken lines are merely theoretical dimensions defining the guide portion 10, for example, and for better illustration thereof. Similar guide portions 10 are also located beneath the other butt or butts 9 (FIG. 3).

The guide portions 10 need not all be of the same width. The leading guide portion 10' of FIG. 1, for example, is substantially narrower than the central guide portion 10 beneath the butt 8. Guide portion 10' is located adjacent the groove portion 6.

In the embodiment of FIG. 1, the two guide portions 10, 10' are spaced from each other and define therebetween an elongated opening 11, which has a longitudinal axis extending parallel to a line of symmetry of the needle shaft 7. The opening 11 is limited at the upper and lower sides by the facing inner surfaces of narrow connecting bridge portions 12, the connecting bridge portions 12 having a width, in the up-down direction with respect to FIG. 1, of at the most 1.1 mm.

In accordance with a feature of the invention, an elastic material 13, damping vibrations or oscillations arising in the needle shank, is located in the opening 11 which is bounded by the connecting bridge 12 or, in FIG. 1, the two connecting bridges 12, and the facing surfaces of the guide portions 10, 10'. Material 13 is securely connected with the surrounding material of the shaft. The shaft, typically, is steel. The vibration-damping material, preferably, is a plastic material; other elastic materials, such as metals, for example aluminum, may be used. The elastic material is securely bonded or connected to the facing edges and surfaces of the connecting bridge portions and the guide portions, respectively.

Figure 2:
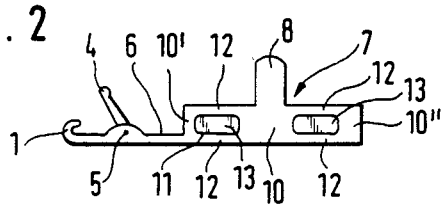
FIG. 2 is a schematic side view of another arrangement of the needle of FIG. 1.

The embodiments of FIGS. 2 and 3 differ from the embodiment of FIG. 1 only in the provision of more than one elongated opening 11 which, respectively, are bounded at the upper and lower sides by connecting bridges 12, the width of which is at the most 1.1 mm; the lateral boundary of the spaces 11 is defined by guide portions 10, 10', respectively. Each one of the openings 11 is filled with vibration-damping material 13, securely bonded to the surrounding facing surfaces of solid steel material of the shank.

The width, measured in longitudinal direction, of the needle of the guide portions 10' located, for example, adjacent the groove portion 6 of the needle may be the same, or approximately the same, as the width of the connecting bridge portions, that is, up to about 1.1 mm width, although they may be slightly wider. The final or end guide portion 10" (FIGS. 2, 3) may be the same as the guide portion 10 beneath the butt 8, slightly narrower, as seen in FIG. 2, or even as narrow as the guide portion 10' (FIG. 10. An intermediate guide portion may be formed between the two butts 8, 9, as seen in FIG. 3, the width of which may be similar to the width of the guide portions 10 beneath the butts 8, 9, or less, up to the width of the guide portion 10' or the connecting bridge 12.

The lengths of the openings 11, filled with the vibration-damping material 13, need not all be the same, as illustrated in FIG. 3; preferably, a symmetrical arrangement should be used—see FIGS. 2 and 3.

Figure 4:
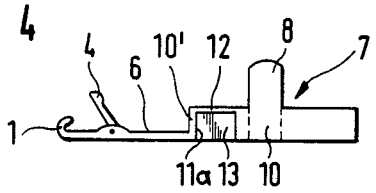
FIG. 4 is a schematic side view of a latch needle with a narrow connecting bridge of at the most 1.1 mm width at the upper edge of the needle.
Figure 5:
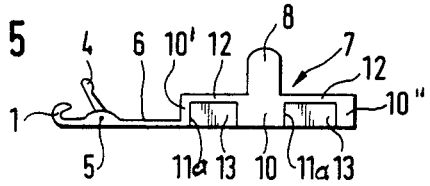
FIG. 5 is a schematic side view similar to FIG. 4, illustrating another embodiment.
Figure 6:
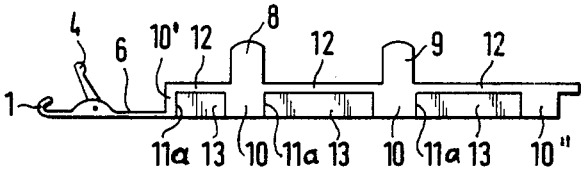
FIG. 6 is a schematic side view of the needle of FIG. 4, illustrating yet another embodiment.

Embodiment of FIGS. 4–6: The openings 11*a* are bounded only on three sides, that is, they are open at an edge. The arrangement, preferably, is such that the openings are free towards the lower edge of the shaft 7, that is, are open to the back of the needle, forming the sliding surface. Each one of the openings 11*a* is, again, filled with elastic material 13. The upper sides of the openings are defined by the lower surface of the connecting bridge portion 12, which, again, have a height of at the most 1.1 mm. The lateral sides of the openings are defined by the facing surfaces of the respective guide portions 10, 10', 10". The respective widths of the guide portions may differ, the guide portion 10' having a width corresponding approximately to the width of the adjacent connecting bridge portion 12.

The vibration-damping material 13 is securely bonded, at the three adjacent sides, with the material of the shaft 7.

Figure 7:
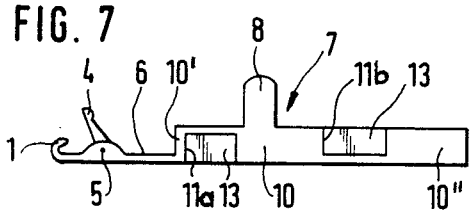
FIG. 7 is a schematic side view of a latch needle having two narrow connecting bridges of, at the most, 1.1 mm width, in which the respective bridges are located at opposite edges of the needle.
Figure 8:
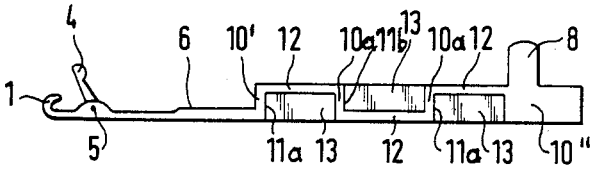
FIG. 8 illustrates an embodiment similar to FIG. 7, in which the bridges are arranged in combination with guide portions in meander shape.
Figure 9:
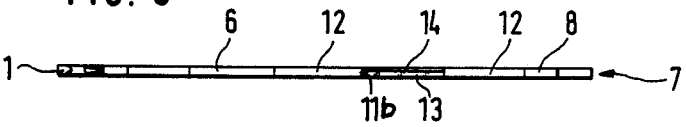
FIG. 9 is a top view of the needle of FIG. 8.

Embodiment of FIGS. 7–9: The openings in the needles of FIGS. 7 to 9 extend in opposite directions and are bounded on only three sides by the steel material of the shafts. Thus, openings 11*a* extend downwardly towards the back of the needle; openings 11*b* extend towards the top—with reference to FIGS. 7 and 8. The arrangement is such that the respective openings 11*a*, 11*b* alternately face the upper and lower edge of the shaft 7, respectively. The openings 11*a*, 11*b* are separated from each other by respective guide portions 10. The connecting bridge portions 12 have a width of the most 1.1 mm; the leading guide portions 10', likewise, may be of a similar dimension or only slightly larger.

In the embodiment of FIG. 8, the guide portion 10 extends for a somewhat longer distance than the region beneath the butt 8; the trailing guide portion 10" is of approximately the same length. The openings 11*a*, 11*b* again retain vibration or oscillation-damping elastic material 13 which is securely bonded at its edges with the facing material of the guide portions and connecting bridges of the needle 7.

The vibration-damping material 13 is usually located in the respective openings such that the adjacent lateral surfaces of the vibration-damping material 13 and of the guide portions and connecting bridges are flush. This is not necessary, however, and the damping characteristics of the vibration or oscillation-damping material may be influenced by offsetting one or both of the lateral surfaces of the damping material 13 with respect to the lateral surfaces of the remainder of the shaft 7, as shown at 14 in FIG. 9.

FIG. 8 illustrates an embodiment of the invention in which the leading guide portion 10' and two intermediate guide portions 10*a* connect respectively positioned bridge portions 12 which are not in longitudinal alignment but, rather, are offset to extend adjacent the upper side of the needle or the back side of the needle, respectively, so that the combination of the guide portions 10', first connecting bridge portion 12, 10*a*, second connecting bridge portion 12, second guide portion 10*a*, and the third connecting bridge portion 12 form a meander-shaped arrangement. The respective guide portions 10', 10*a* have a width dimension corresponding, at least approximately, to that of the connecting bridges 12 which, each, have a width of at the most 1.1 mm. The guide portions 10', 10*a* may, for example, be of the same dimension.

Various changes and modifications may be made, and any features described herein may be used with any of the others, within the scope of the inventive concept.

The bridge portion is usually less than 1 mm high.

A typical knitting machine needle, for example of the type shown in the drawings, will have a shank height or blade height of, for example, about 3 mm and a bridge portion of 0.9 mm, so that the dimension of the opening beneath the bridge portion 12 will have a height of about 2.1 mm. A typical longitudinal extent for the vibration-damping material, for example filling the opening in FIG. 4, is 8 mm, and filling the second and third openings of FIG. 6 is 15–20 mm. A typical plastic material suitable for bonding through the adjacent metal surfaces of the needle shank is Polyamide 6.6 or any material having similar characteristics.

I claim:

1. Composite punched knitting element for use in a knitting machine having an elongated shaft (7) having an upper edge and a lower, or back-of-needle edge;

a head (1, 2) located at one end of the knitting element;

and at least one butt (8, 9) extending from the shaft, said shaft defining at least two spaced solid guide portions (10) extending from an upper edge of the shaft to the lower edge of the shaft, at least one of said guide portions being located in alignment with the butt;

and wherein the shaft comprises the combination of at least one connecting bridge portion (12) connecting two neighboring guide portions (10), said bridge portion being of up to 1.1 mm height and defining an opening which is bounded by the at least one connecting bridge portion and facing edges of the spaced neighboring solid guide portions within a plan outline of the shaft (7)

with vibration-damping or oscillation-damping material (13) filling said opening and securely connected to the edges of the at least one bridge portion (12) and the spaced solid guide portions (10, 10', 10'', 10*a*) facing said opening.

2. Knitting element according to claim 1, wherein said connecting bridge portion (12) forms at least one of said edges of the element shaft (7).

3. Knitting element according to claim 1, wherein said element comprises two bridge portions connecting neighboring guide portions (10).

4. Knitting element according to claim 1, wherein said element comprises two bridge portions (12) connecting neighboring guide portions, one each bridge portion being located adjacent to, and defining, respectively, an upper edge and a lower edge of the shaft.

5. Knitting element according to claim 1, wherein said element comprises one bridge portion extending in, respectively, one direction and connecting neighboring guide portions.

6. Knitting element according to claim 5, wherein the respective bridge portion defines at least one of the edges of the element shaft (7).

7. Knitting element according to claim 1, wherein the widths of the guide portions (10, 10', 10'', 10*a*) are unequal.

8. Knitting element according to claim 7, wherein the guide portions (10', 10'', 10*a*) out of alignment with the at least one butt (8, 9) are substantially narrower than the guide portion (10) in alignment with the at least one butt.

9. Knitting element according to claim 1, wherein the element comprises (FIGS. 2, 3, 5–8) at least three spaced guide portions defining two outer and one central guide portion, and two bridge portions are provided extending from the central guide portion in alternate directions.

10. Knitting element according to claim 9, wherein (FIGS. 2 and 3) said element comprises two bridge portions (12) connecting neighboring guide portions, one each bridge portion being located adjacent to, and defining, respectively, an upper edge and a lower edge of the shaft.

11. Knitting element according to claim 9, wherein (FIGS. 5, 6) one bridge portion, each, extends in either direction from the central guide portion, and said bridge portions are located in longitudinal alignment.

12. Knitting element according to claim 9, wherein the guide portions (10', 10'', 10*a*) out of alignment with the at least one butt (8, 9) are substantially narrower than the guide portion (10) in alignment with the at least one butt.

13. Knitting element according to claim 10, wherein the guide portions (10', 10'', 10*a*) out of alignment with the at least one butt (8, 9) are substantially narrower than the guide portion (10) in alignment with the at least one butt.

14. Knitting element according to claim 11, wherein the guide portions (10', 10'', 10*a*) out of alignment with the at least one butt (8, 9) are substantially narrower than the guide portion (10) in alignment with the at least one butt.

15. Knitting element according to claim 1, wherein the vibration damping or oscillation-damping material (13) filling said opening (11, 11*a*, 11*b*) comprises plastic material.

16. Knitting element according to claim 1, wherein the vibration or oscillation-damping material (13) filling said opening (11, 11*a*, 11*b*) is flush with the adjacent side surfaces of the remainder of the material of said shaft (7).

17. Knitting element according to claim 1, wherein said vibration or oscillation-damping material (13) filling said opening (11, 11*a*, 11*b*) is laterally inwardly recessed (14) with respect to the lateral side surfaces of the remainder of the material of the shaft (7).

18. Knitting element according to claim 2, wherein the vibration or oscillation-damping material (13) filling said opening (11, 11*a*, 11*b*) comprises plastic material.

19. Knitting element according to claim 2, wherein the vibration or oscillation-damping material (13) filling said opening (11, 11*a*, 11*b*) is flush with the adjacent side surfaces of the remainder of the material of said shaft (7).

20. Knitting element according to claim 3, wherein the vibration-damping or oscillation-damping material (13) filling said opening (11, 11*a*, 11*b*) has side surfaces which are located between a slight distance inwardly recessed with respect to the lateral side surfaces of the remainder of the material of the shaft (7) and extending up to flush with said lateral side surfaces of the remainder of the material of the shaft.

21. Composite punched knitting element for use in a knitting machine having an elongated shaft (7) having an upper edge and a lower or back-of-needle edge;

a head (1, 2) located at one end of the knitting element;

and at least one butt (8, 9) extending from the shaft, wherein said shaft defines at least three spaced solid guide portions (10) extending from an upper edge of the shaft to the lower edge of the shaft, at least one of said guide portions being located in alignment with the butt;

said at least spaced guide portions defining two outer and one central guide portions;

and wherein the shaft comprises at least two connecting bridge portions (12), connecting two neighboring spaced guide portions (10), said bridge portions being up to 1.1 mm height and defining an opening which is bounded by the respective connecting bridge portions and facing edges of the respective spaced neighboring solid guide portions within a plan outline of the shaft, said bridge portions, each, extending in either direction from said central guide portion, and the relative positions of the bridge portions extending from said central guide portion, with respect to the height dimension of the shaft (7) are offset and positioned, respectively, alternately adjacent the upper and lower edges of the shaft (7) to form a meander pattern of a guide portion, a bridge portion at one edge of the shaft, the central guide portion, and another bridge portion located adjacent the other edge of the shaft, longitudinally staggered and heightwise offset from said first-mentioned bridge portion, and the third guide portion;

with vibration-damping or oscillation-damping material (13) filling said openings and securely connected to the edges of the respective bridge portion

(12) and the spaced solid guide portions (10, 10', 10'', 10*a*) facing the respective opening.

22. Knitting element according to claim 21, wherein the guide portions (10', 10'', 10*a*) out of alignment with the at least one butt (8, 9) are substantially narrower than the guide portion (10) in alignment with the at least one butt.

23. Knitting element according to claim 21, wherein the vibration-damping or oscillation-damping material (13) filling said opening (11, 11*a*, 11*b*) comprises plastic material.

24. Knitting element according to claim 21, wherein the vibration-damping or oscillation-damping material (13) filling said opening (11, 11*a*, 11*b*) is flush with the adjacent side surfaces of the remainder of the material of said shaft (7).

25. Knitting element according to claim 21, wherein said vibration-damping or oscillation-damping material (13) filling said opening (11, 11*a*, 11*b*) is laterally inwardly recessed (14) with respect to the lateral side surfaces of the remainder of the material of the shaft (7).

26. Knitting element according to claim 1, wherein the vibration-damping or oscillation-damping material (13) filling said opening (11, 11*a*, 11*b*) has side surfaces which are located between a slight distance inwardly recessed with respect to the lateral side surfaces of the remainder of the material of the shaft (7) and extending up to flush with said lateral side surfaces of the remainder of the material of the shaft; and wherein the vibration-damping or oscillation-damping material (13) filling said opening (11, 11*a*, 11*b*) comprises a plastic material having the characteristics of polyamide 6.6.

27. Knitting element according to claim 21, wherein the vibration-damping or oscillation-damping material (13) filling said opening (11, 11*a*, 11*b*) has side surfaces which are located between a slight distance inwardly recessed with respect to the lateral side surfaces of the remainder of the material of the shaft (7) and extending up to flush with said lateral side surfaces of the remainder of the material of the shaft; and wherein the the vibration-damping or oscillation-damping material (13) filling said opening (11, 11*a*, 11*b*) comprises a plastic material having the characteristics of polyamide 6.6.

* * * * *